United States Patent [19]

Nelson

[11] 4,307,982

[45] Dec. 29, 1981

[54] MOBILE MINE ROOF SUPPORT SYSTEM

[75] Inventor: Robert C. Nelson, Bluefield, W. Va.

[73] Assignee: Mining Machinery Development Corp., Bluefield, W. Va.

[21] Appl. No.: 127,780

[22] Filed: Mar. 6, 1980

[51] Int. Cl.[3] ..... E21D 15/44

[52] U.S. Cl. ..... 405/297; 405/299; 405/288

[58] Field of Search ..... 405/288, 291, 297–301; 98/50; 175/219; 299/31, 33

[56] References Cited

U.S. PATENT DOCUMENTS

| | | | |
|---|---|---|---|
| 2,795,936 | 6/1957 | Blower et al. | 405/300 |
| 3,811,290 | 5/1974 | Swoager | 405/299 |
| 3,892,100 | 7/1975 | Jamison | 405/291 |
| 4,026,118 | 5/1977 | McCay | 405/291 |
| 4,129,990 | 12/1978 | Valantin | 405/299 |
| 4,143,991 | 3/1979 | Stafford | 405/291 |

*Primary Examiner*—David H. Corbin

*Attorney, Agent, or Firm*—McCaleb, Lucas & Brugman

[57] ABSTRACT

A mobile self-propelled mine roof support system employing pairs of individually self-propelled roof support units movable along opposite ribs of a mine room to follow an advancing mine face. Each support unit comprises an elongated, wheel-mounted frame positioned along the adjacent rib. Pairs of vertical jacks are connected to opposite sides of the frame, being positioned loosely, and vertically movable, within oversize openings in brackets attached to the frame. A foot plate is universally pivotally attached to the lower ends of each pair of jacks and extends across the underside of the frame. A top-supporting canopy is universally pivotally attached across the upper ends of each pair of jacks and has an overhanging portion extending cantileverly into the room toward the opposite support unit. The jacks have external flanges engagable with the brackets. When the jacks fully retract the foot plate from the mine bottom upwardly against the underside of the frame, the entire assembly including the canopies is clamped rigidly between the brackets and the underside of the frame to lock the canopies to the frame for tramming. After the pairs of jacks press the foot plates downwardly against the bottom, the jacks shift upwardly to disengage their external flanges from the brackets and to press the canopies against the mine top. In an alternate embodiment, the ends of the canopies of the opposite roof support units are interconnected by wire ropes or chains and tensioned by hydraulic cylinders to support the top at the center of the room. A horizontally swingable inbye section of the frame has at least one canopy to continuously support the top when the mining operation changes direction, as when it makes a breakthrough from one room to another.

17 Claims, 18 Drawing Figures

PORT "A"
PORT "B"
PORT "C"
80
70
75
73
68
150
106
108
110
88
74
136
138
139
140
142
144
146
148
152
154
34
112
114
116
126
132
180
182
204
206
208
14A
4A
5
6

33'
20
22
22a
24
24a
26
28
30
32
76
180
184
184'
184"
186
188
190
212
214
216
218

MOBILE MINE ROOF SUPPORT SYSTEM

BACKGROUND OF THE INVENTION

1. Field of the Invention

This invention relates to an underground mine roof support and system adapted to follow an advancing mine face in a shortwall mining operation to protect personnel and equipment from roof falls while providing ready access to the face by mining equipment.

2. Description of the Prior Art

In mining operations such as the continuous mining of coal, no one prior to the present invention has successfully solved the problem of temporarily supporting the freshly-cut top or roof of a mine room just behind a continuous miner. Typically, about twenty feet of the top immediately outbye of the face is inaccessible to a roof bolting machine because the continuous miner and the shuttle car loading coal from it are in the working place. As a consequence, the miner must be moved to the next working place available, while a roof bolting machine moves into the freshly-cut place to install the required number of bolts. Further, though the miner itself is capable of operating continuously, it actually operates less than full-time in a conventional mining operation because of delays involved in moving from place to place and roof bolting.

Mining equipment and the labor to operate it are very expensive. Ideally, such equipment should be kept running all the time to minimize the cost per ton of mined material. Much effort has been spent in attempting to develop temporary roof support above a mining machine which will advance with a miner and enable it to operate continuously without down time to roof bolt on reset timbers. Some walking roof supports which have been proposed for this purpose are illustrated and described in U.S. Pat. Nos. 2,795,935; 2,795,936; 3,890,792; 4,129,990; and 4,143,991. None has been entirely satisfactory. The most recently publicized attempt to solve this problem has been based on the above U.S. Pat. No. 4,143,991, reported at pages 50–61 of the June, 1979 issue of "Coal Age". It had a series of individually movable transverse bars engagable with the roof. Although several prototypes of this machine have been made and tested, it is understood that several unsolvable problems developed, some of which were inherent in the design. Serious problems were the inability to turn cross-cuts, and to turn corners when making breakthroughs from one room to another.

Another problem in the design shown in U.S. Pat. No. 4,143,991 was permanent deformation of the roof support bars each of which extended completely across the room in one piece with no intermediate support. Further, the fixed width of the roof-engaging bars must be two feet or so less than the full width of the room itself to accommodate room neck-downs.

SUMMARY OF THE INVENTION

It is a general object of the present invention to provide mine roof support apparatus which can advance with a mine face in a shortwall, or room and pillar mining, system, to temporarily protect workers and equipment from roof falls in the freshly-mined portion of the room just outbye of the face which is not accessible to permanent roof bolting equipment while the working place is occupied by a continuous miner and backup haulage equipment.

Another object is to provide a temporary mine roof support system comprising a pair of separate, mobile roof support units positioned side-by-side along opposite ribs of a mine room, each unit having an elongated body with jacks supporting roof-engagable canopies which overhang cantileverly into the room, providing clearance between them for mining machinery to work back and forth.

Another object is to provide such a roof support unit for such a mobile roof support system in which roof-engagable canopies and ground-engagable foot plates are transversely supported respectively above and below the frame by pairs of jacks through universally pivotal connections enabling the canopies and foot plates to conform to non-level surfaces.

Another object is to provide such a mobile roof support unit in which the pairs of jacks are loosened from the body in response to extending the canopies and foot plates respectively toward the top and bottom of the room to enable the unit to conform to non-level top and bottom surfaces; and, further, the jacks are fixed relative to the body in response to retracting the canopies and foot plates toward the frame to lock the canopies and other parts to the frame for tramming.

Another object is to provide such a mobile roof support unit with a horizontally swingable inbye section having at least one canopy and foot plate enabling it to continuously support the top when the mining operation changes direction, as when mining a cross-cut, or making a breakthrough from one room to another.

Another object is to provide such a mobile roof supporting unit in which each pair of jacks has separately actuatable upper and lower portions connected to the corresponding canopy and foot plate respectively.

Another object is to provide such a mobile roof support system in which the canopies on the units are opposite sides of a room are interconnected by auxiliary roof support elements to support the mine top at the center of the room between the canopies.

BRIEF DESCRIPTION OF THE DRAWINGS

Other objects and advantages will be apparent from the following description taken in connection with the drawings in which.

Like parts are referred to by like reference characters throughout the figures of the drawings.

DESCRIPTION OF THE PREFERRED EMBODIMENTS

Figures 1, 4A:
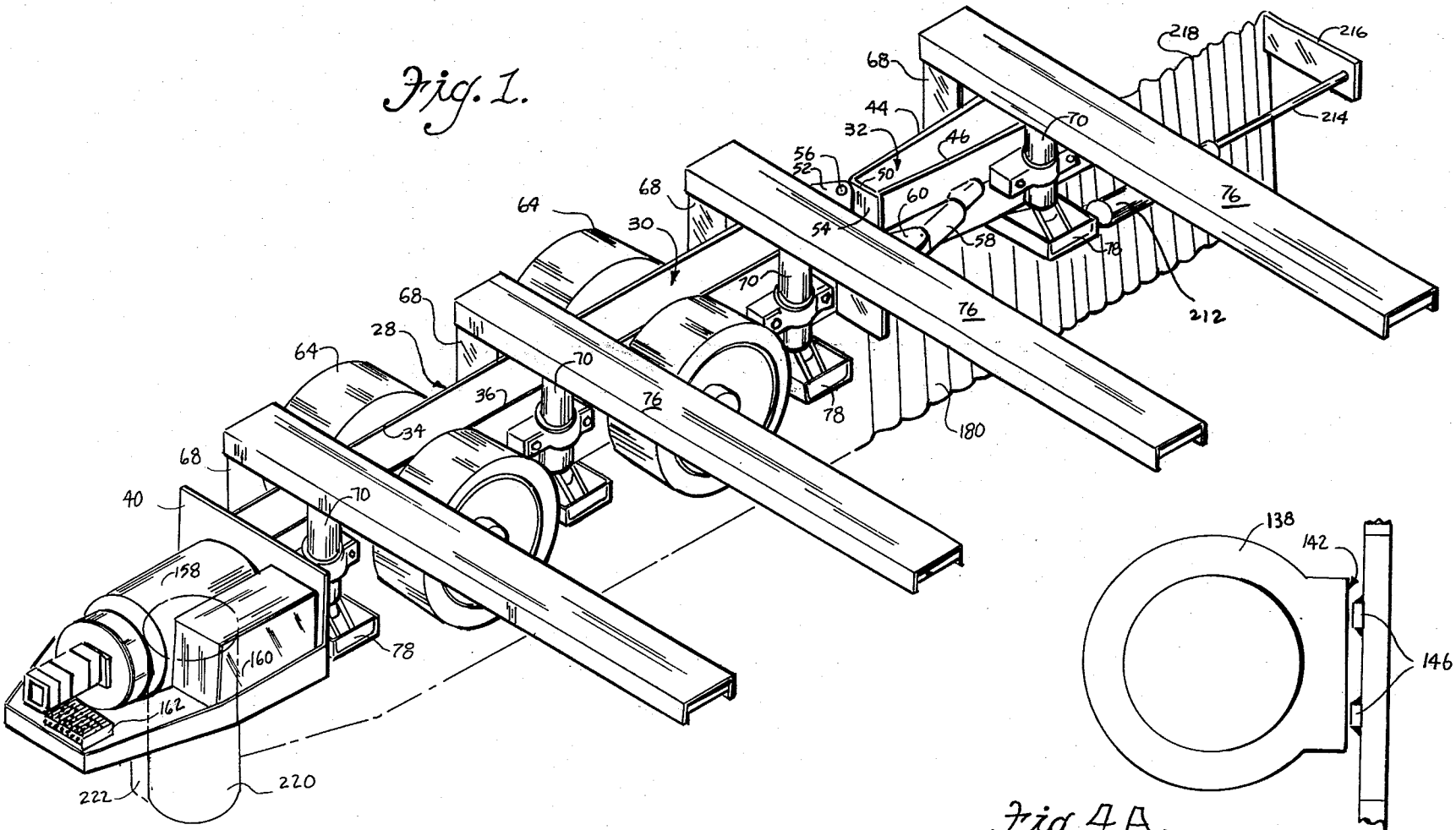
FIG. 1 is a perspective view of one of a pair of self-advancing mine roof support units utilized in the present invention.
FIG. 4A is a fragmview of FIG. 4 taken along line 4A—4A.

Referring now to the drawings, and more particularly to the embodiments shown in FIGS. 1–13, the improved mine support system is generally designated 20 (see FIGS. 8–12, for the overall system). The system comprises a pair of similar mine roof support units 22 and 22*a* positioned side by side along opposite ribs 24 and 24*a* of a mine room 26.

Figure 3:
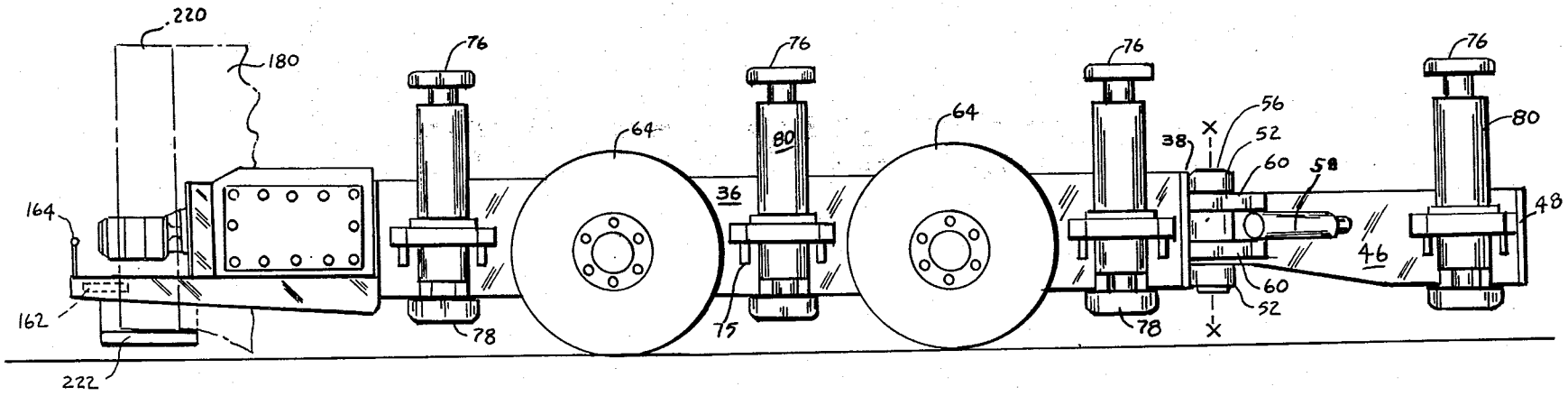
FIG. 3 is a side view of FIG. 2.

The mine roof support units 22 and 22*a* are made of substantially identical components, so only unit 22 will be described in detail. Each unit 22 has an elongated frame 28 extending along an adjacent rib 24. Frame 28 comprises a fixed main section 30 and a horizontally swingable auxiliary section 32 pivoted thereto about a vertical pivot axis X—X (FIG. 3). The main frame section has a pair of vertical side plates 34 and 36 interconnected at inbye and outbye ends respectively by plates 38 and 40. The latter is part of a housing 42 for power and control components. Similarly, the auxiliary frame section 32 has a pair of side plates 44 and 46 interconnected by end plates 48 and 50. The two frame sections 30 and 32 have hinge brackets 52 and 54 interconnected by a vertical pivot pin 56. A hydraulic swing cylinder 58 is connected between brackets 60 and 62 on the plate 38 and auxiliary frame section 32 respectively, to swing the latter from side to side.

Each roof support unit 22 is supported and propelled by tramming means which is here illustrated as ground-engaging wheels 64 arranged in two pairs on opposite sides of the main frame section 30. They are rotatably supported on the side plates 34 and 36 and driven in inbye or outbye directions, as desired, by individual hydraulic motors 66. Alternatively, crawlers (not shown) may be substituted for the wheels. This may be desirable if the mine bottom or floor is very soft, wet, or slippery.

Pairs of vertical jacks 68 and 70, loosely held at intervals along the elongated frame 28, by brackets 72 (on the rib side) and 74 (on the non-rib side), have roof supporting canopies 76 across their upper ends and ground engaging foot plates 78 across their lower ends.

Each jack 68 and 70 has a cylindrical body 80 with upper and lower internal cylindrical bores 82 and 84 which are here shown as the same diameter. Optionally, they may be different diameters. Each has an upper piston 86 with a rod 88 reciprocably journaled through an upper cylinder head 90; and a lower piston 92 with a rod 94 similarly journaled through lower cylinder head 96. O-rings, or other fluid sealing elements 98, 100, 102 and 104, prevent leakage between the rods, heads, and cylinders at places shown in FIG. 5. The pistons 86 and 92 are annular, and having an outer cylindrical surface 106 (FIG. 4B) slidable up and down against the respective inner bore 82 and 84 of the cylinder body. The heads 90 and 96 have central openings 108 engaging necked-down inner end portions of the corresponding rods 88 and 94. Large bolts 110 are threaded into the inner ends of the rods and hold the pistons assembled substantially integrally therewith. Fluid inlet and outlet ports A, B, and C provide access through the cylindrical body 80 respectively to the rod end of the upper piston, to the space between the pistons, and to the rod end of the lower piston.

Each end of each vertical jack 68 and 70 is universally pivotally connected to the canopies 76 and foot plates 78. This enables them to accommodate deviations of the floor and roof from the horizontal in any direction. Each of these universally pivotal connections comprises an arched end extension 112 fastened as by welding to the end of the respective rod 88 or 94. Horizontal surfaces 114 engage complementary horizontal outer surfaces 116 of the respective head 90 or 96 to limit inward retraction of the pistons, as shown in FIGS. 4–7.

Figure 5:
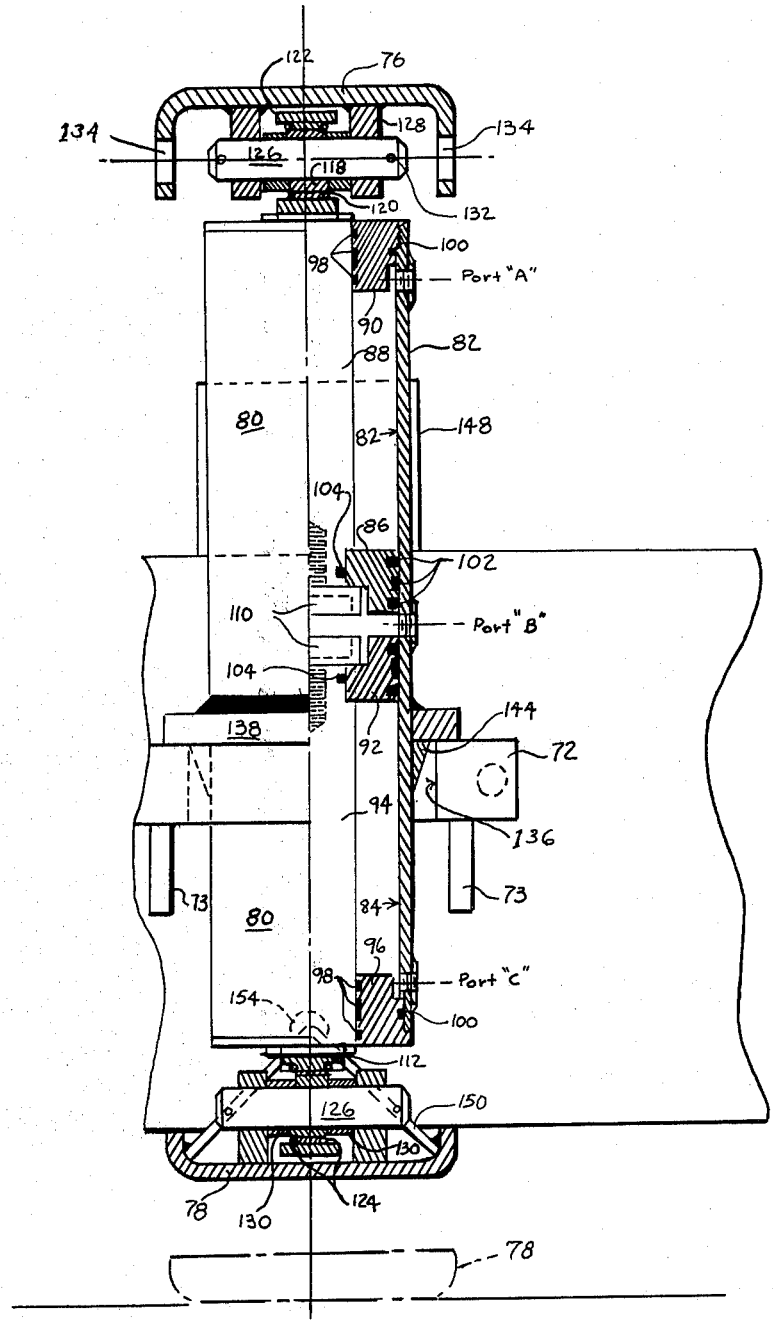
FIG. 5 is a vertical cross-sectional view of FIG. 4 taken along line 5—5.

As best shown in FIG. 5, steel ball bushing, with inner and outer races 118 and 120 respectively, is held in a circular opening 122 in each extension 112 by spring retainer rings 124. A pivot pin 126 extends through the inner race 118 and is mounted in ears 128 which are welded to the canopies 76 at the top and to the foot plates 78 at the bottom. The inner races 118 are centered between ears 128 by short tubular spacers 130. The pins 126 are held in place by roll pins or cotter pins 132. Access to the pins is provided by openings 134 in the canopy skirts. Thus, the canopies and foot plates can readily orient themselves to any angle and bear effectively against non-level top and bottom room surfaces.

Figures 4, 4B:
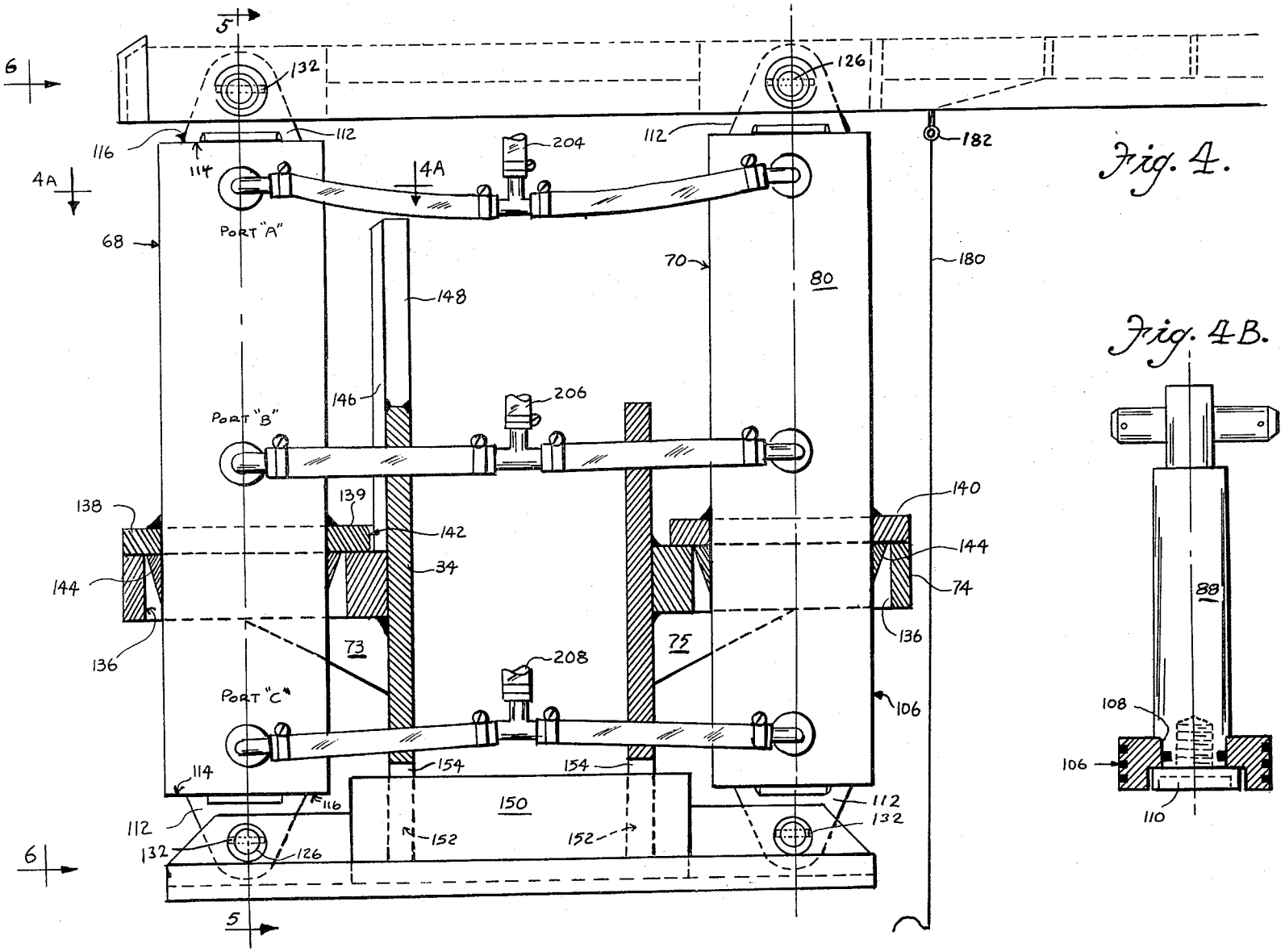
FIG. 4 is a vertical sectional view of FIG. 2 taken along line 4—4.
FIG. 4B is a view of one of the piston subassemblies shown in FIG. 5.

As best shown in FIGS. 4 and 5, each jack 68 and 70 extends through an oversize opening 136 in each of the brackets 72 and 74. Gussets 73 and 75 reinforce them. The jack bodies 80 have external flanges, designated 138 on the rib side and 140 on the non-rib side. They are substantially identical except that flanges 138 have integral slide plate extensions 139 with flat slide surfaces 142 for a purpose which will be described below.

Figure 6:
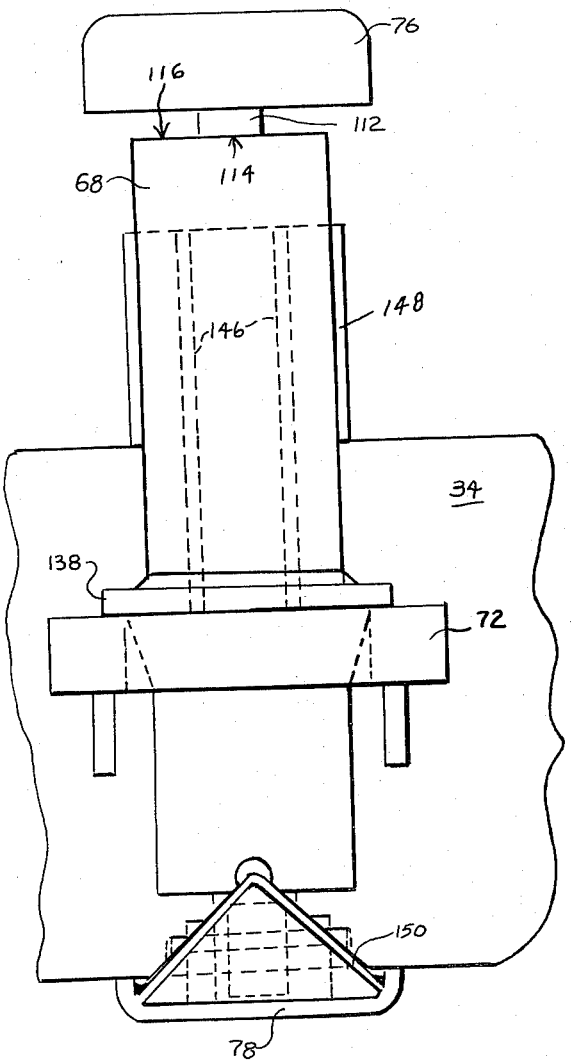
FIG. 6 is a vertical view of FIG. 4, as seen in direction of the arrows 6—6, showing the rib-side jack in retracted or tramming position, with the canopy, jacks, and foot plate locked rigidly to the frame for tramming.
Figure 7:
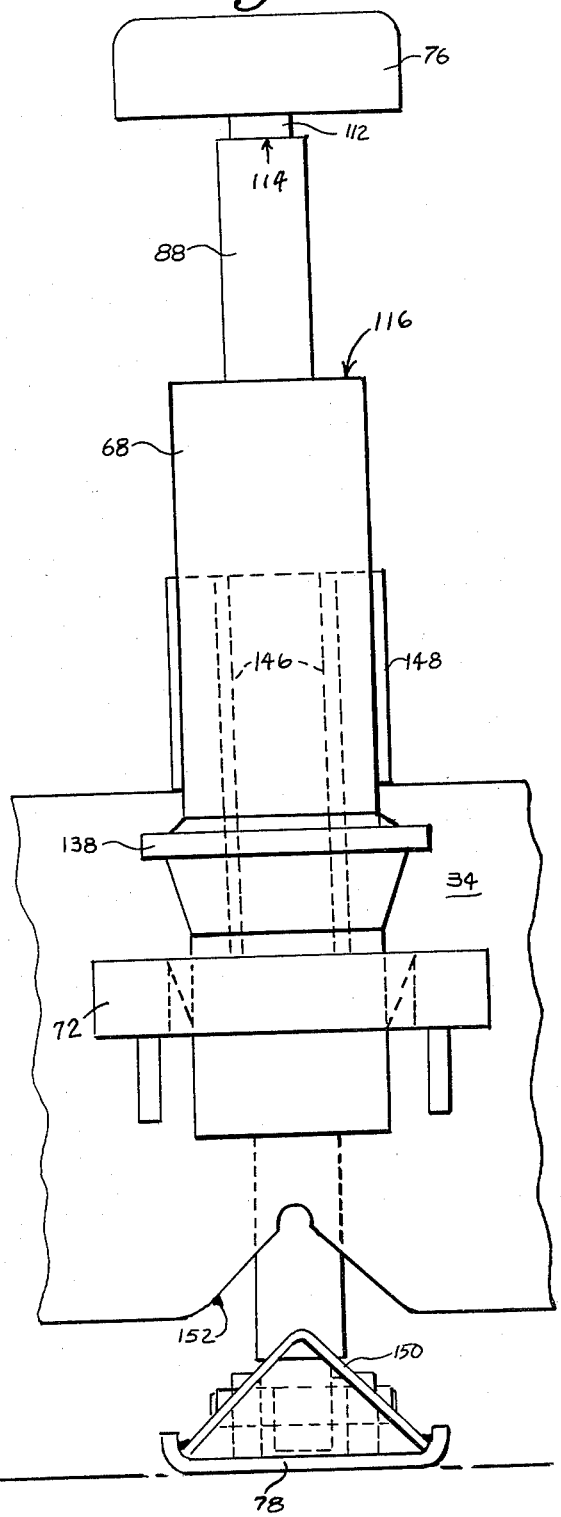
FIG. 7 is a view similar to FIG. 6, showing the jacks extended to the operating position, out of engagement with the frame, pressing one of the canopies and its corresponding foot plate respectively against the mine top and bottom.

When the jacks are fully retracted as shown in FIGS. 4, 5, and 6, the flanges 138 and 140 support the weights of the canopies, jacks and foot plates by bearing directly on the tops of the brackets 72 and 74. A conical sleeve 144 is fixed as by welding to the outside of the cylindrical body 80 just beneath each flange. These conical sleeves guide and center the jacks when they are lowered by the pistons through the openings 136.

Referring to FIGS. 4 and 4A, the slide surfaces 142 on the rib-side jacks bear against pairs of vertical wear strips 146 which are fastened as by welding to the rib-side frame plates 34 and 44, above the brackets 72. The wear strips continue upwardly onto vertical extensions 148 of the frame side plates. By providing a relatively small clearance between the surfaces 142 and the corresponding wear strips 146, as shown in FIG. 4, the structure is stabilized against any tendency of the heavy, off-center, cantilever canopies to lean the jacks inwardly toward the center of the room. Optionally, if desired, this slide/guide arrangement may be duplicated for the non-rib side jacks 70. As a practical matter, they are likely to be needed only for the rib-side jacks, as shown.

An inverted V-shaped centering plate 150 is mounted on the top of each foot plate 78. This seats upwardly within pairs of inverted V-slots 150, 150 formed in the bottom edges of the frame side plates 34/36 and 44/46 in the retracted, tramming position shown in FIGS. 4, 5 and 6. The apex of each V-slot is enlarged, with a mud clearance opening 154. Thus, when the jacks are fully retracted, to the tramming position, with the flanges 138 and 140 bearing downwardly on the tops of brackets 72 and 74, and V-plates 150 seated upwardly in slots 152, the entire assembly will be held in stable, rigid, retracted conformation for advance or retract along the rib.

Hydraulic power to drive the tramming motors 66 to advance or retreat the unit, and power to pressurize the swing cylinder 58 for the auxiliary frame 32, and power to extend and retract the pairs of vertical jacks 68 and 70, is provided by a pump 156 driven by motors 158. Motor control is provided by a conventional starter 160.

Figures 2, 2A:
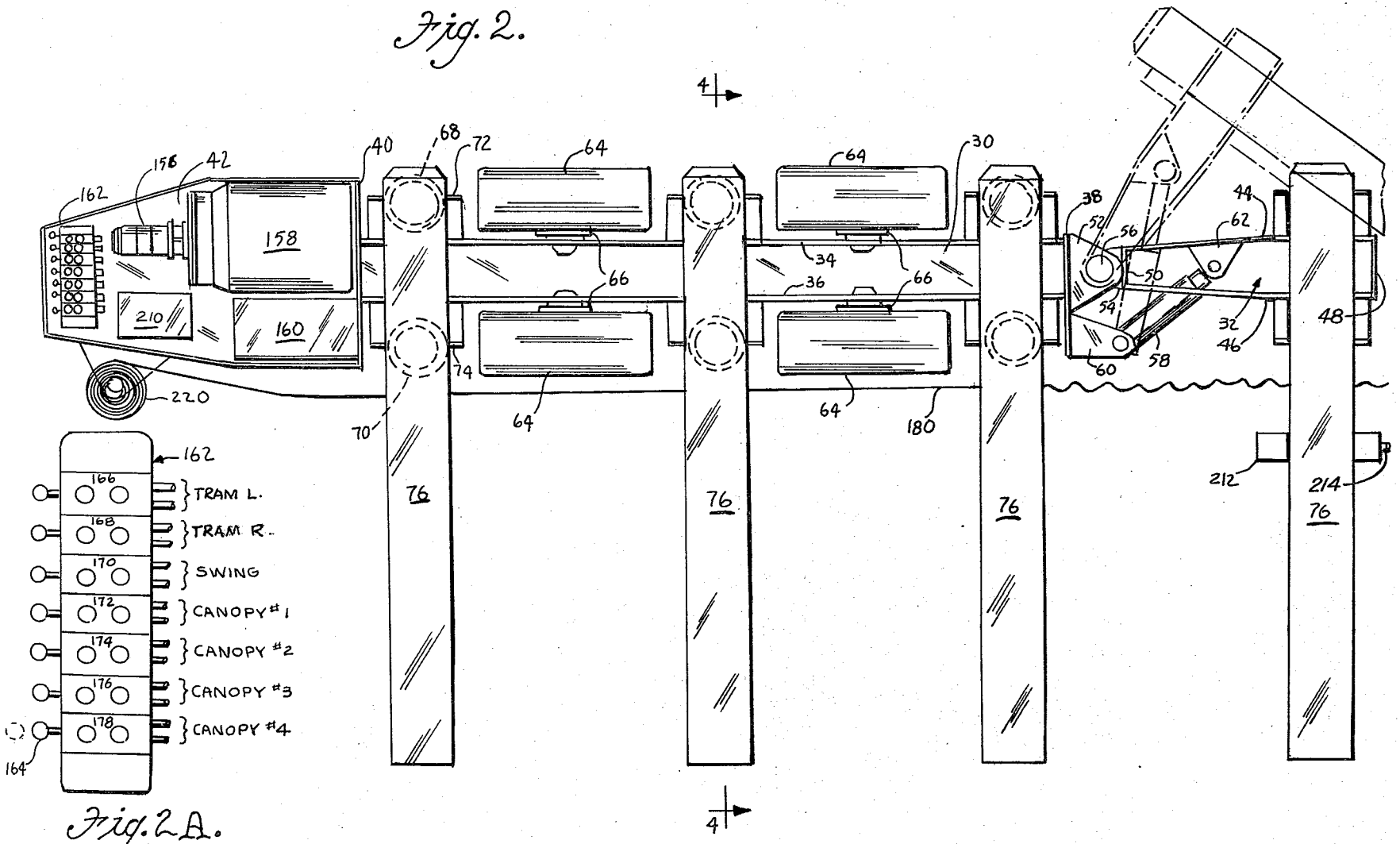
FIG. 2 is a top, plan view of FIG. 1.
FIG. 2A is an enlarged view of the valve bank shown in FIG. 2.

Details of the various hydraulic lines interconnecting the components will be obvious to any one skilled in this art, so they have been omitted from the drawings for clarity. Briefly, however, a bank 162 of manually operable control valves is shown in FIGS. 1 and 2, and enlarged in FIG. 2A. Each valve has an individual manually manipulatable handle 164 which can be pressed forward or rearward from a neutral center position.

Valves 166 and 168 actuate the tramming motors 66 on the left and right sides of the frame respectively. By pressing the handles of both valves concurrently forwardly or backwardly, the mobile roof support unit will tram straight forward or backward. By pressing the handles in opposite directions, the unit can be steered by driving opposite wheels in opposite directions. Valve 170 controls swing cylinder 58. Each of the valves 172, 174, 176, and 178 control one of the four pairs of jacks 68, 70, selectively directing fluid under pressure into ports A, B C through hoses 204, 206 and 208 respectively, while returning fluid as necessary to tank 210.

By actuating a selected one of valves 172–178, in one direction, ports A and C of the corresponding pair of jacks 68, 70 are pressurized concurrently through hoses 204 and 208 while port B returns fluid to tank 210 through hose 206. Initially, when ports A and C are pressurized, only the lower pistons 96 move upwardly while the jack bodies 80 slide downwardly within bracket openings 136. When the flanges 138 and 140 drop sufficiently to bear upon brackets 72 and 74, the jacks stop moving downwardly. Continued pressurization through ports A and C lift the foot plates 78 from the floor while the canopies 76 lower from engagement with the top of the room.

Pressurization of all ports C by all four valves 172–178 seats the V-plates 150 solidly in the V-slots 152, and bears all flanges 138, 140 downwardly into the brackets 72, 74. This clamps all the canopies, foot plates, and jack assemblies rigidly to the frame (as shown in FIG. 6) to clear the top and bottom of the room while the mobile roof support unit advances or retreats.

By actuating the valves 172–178 to concurrently pressurize ports B, while ports A and C function to return fluid to tank, the foot plates and canopies may be lowered and raised to engage the floor and roof respectively. At this time, the flanges 138 and 140 will be elevated above the brackets 72 and 74 while the slide plates 139 and slide surfaces 142 slide upwardly along the wear strips 146.

A ventilating curtain 180 may be attached to the canopies in a manner to provide a positive seal against the roof and floor respectively. The curtain may be stored in a roll 220 carried on the housing 42 by a bracket 222. The curtain is payed forward as needed for ventilation purposes. To comply with mine regulations concerning face ventilation, the curtain must be kept within ten feet of the face while the continuous miner is operating. To facilitate this, a curtain-extending reversible cylinder 212 is mounted on the underside of the inbye, steerable canopy 76. At the end of the piston rod 214, there is a plate 216 which supports the leading, inbye edge of the curtain 180. The latter may readily be extended and retracted from a remote location (not shown) by remotely actuating the cylinder 212. As shown, the leading portion 218 of the curtain is arranged loosely in pleats or folds to enable extension toward the face and to allow for stretch of the curtain on leftwise turning movement of the auxiliary frame 32.

Figures 8, 9, 10, 11, 12:
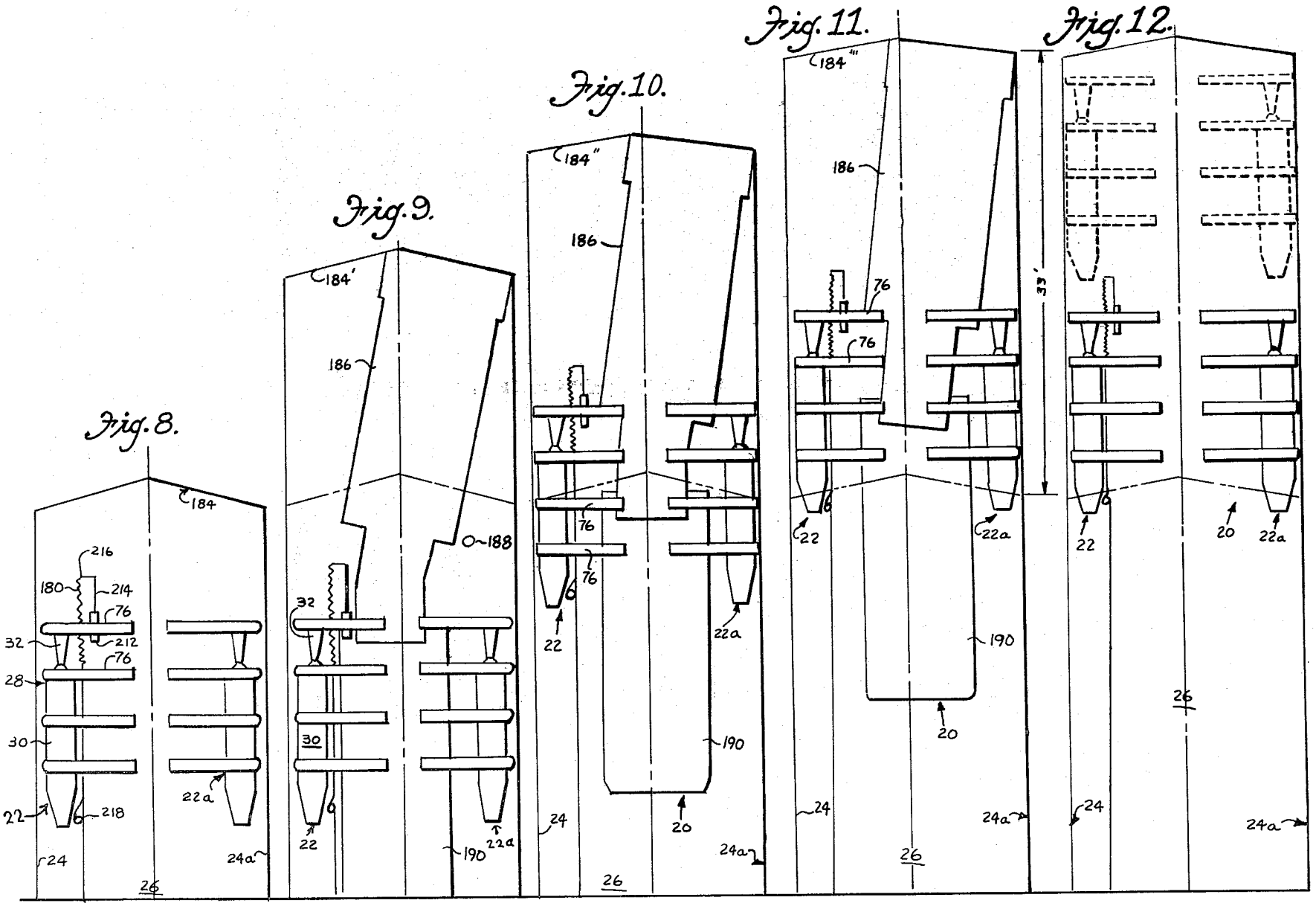
FIGS. 8–12 are successive operating positions of a mine system according to the present invention illustrating a sequence of operation for supporting a mine roof during one advance of a continuous mining machine.

A typical sequence of operations, for room and entry work, is illustrated schematically in FIGS. 8–12 as follows:

Step I (FIG. 8)

The room 26 has been completely roof-bolted all the way up to the face 184 by a roof bolting machine (not shown) which has been moved into and out of the working area under the temporary protection of the roof support units 22 and **22*a*. At the stage shown in FIG. 8, the mine roof support units 22, 22*a* have been moved back, out of the way, to provide space for workmen to begin a new cut and advance the face. Roof bolts on centers of about 4 feet are indicated by X's in FIGS. 8–12**.

Step II (FIG. 9)

A continuous miner 186 moves in under the roof support units 22, **22*a* and advances the mine face approximately twenty feet to a new location indicated 184'. The continuous miner operator stays approximately at the location 188 under the protection of the roof-bolted area. Coal is discharged into a shuttle car 190**.

Step III (FIG. 10)

The mobile roof support units 22, **22*a*** are moved forwardly approximately eighteen feet while the miner continuous to cut coal and load it into the shuttle car.

Step IV (FIG. 11)

The mobile roof support units 22, **22*a*** are moved forward approximately eight feet while the miner continues cutting to a full depth (from Step I) of approximately thirty-eight feet. After moving to this full depth, the miner is retreated from the room and moved to another working place in another room to allow this working place to be roof bolted.

Step V (FIG. 12)

A roof bolter (not shown) moves into the working place and bolts the full thirty-eight feet of new cut. In FIG. 12, the new bolts are shown as heavy black dots. If necessary, the mobile roof support units 22, **22*a*** can be moved forward after the first twenty new bolts are installed, enabling the roof bolting machine operators to work under supported roof at all times.

Figure 13:
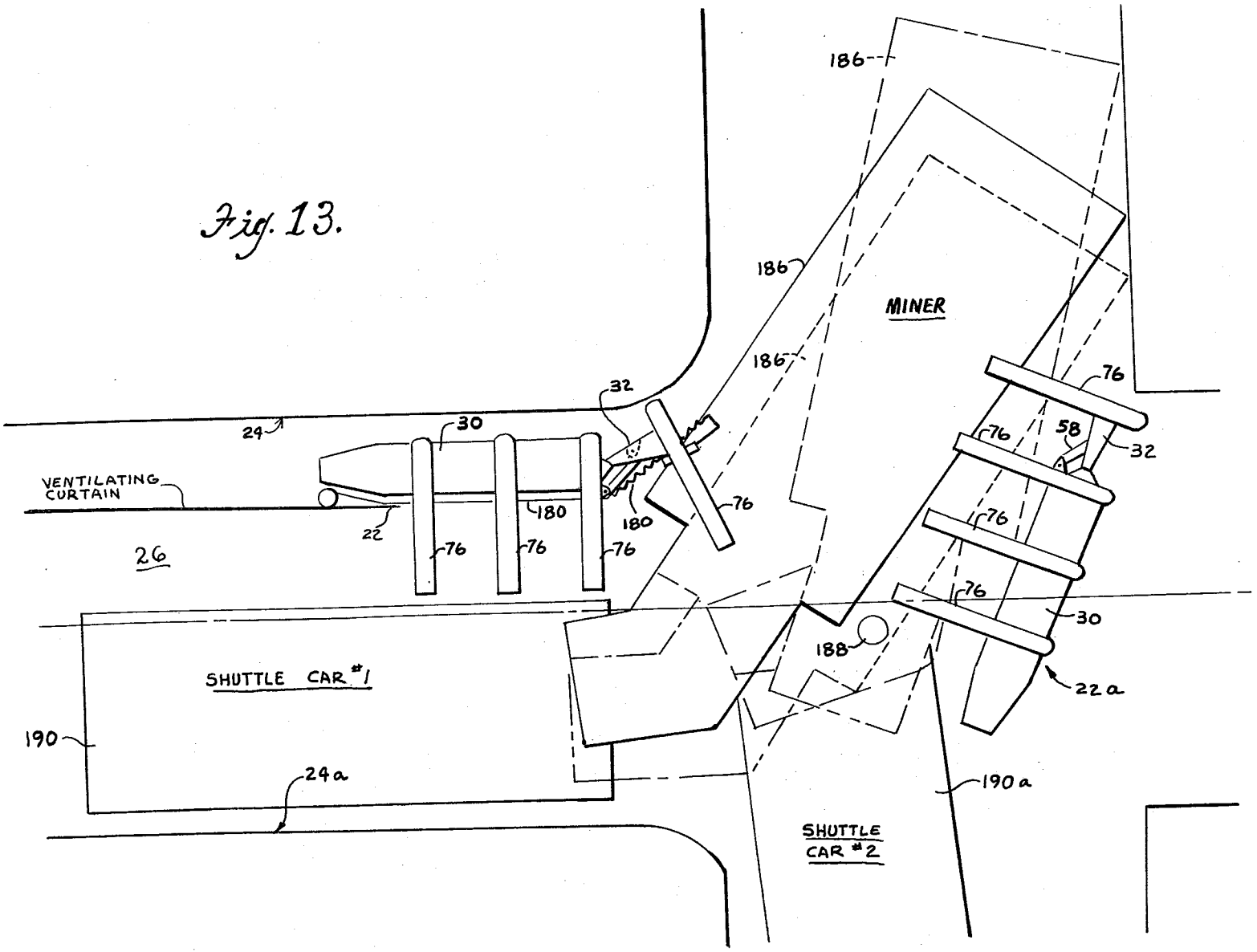
FIG. 13 illustrates a method of making a turn to develop a breakthrough with the present invention.

FIG. 13 illustrates use and operation of the mobile roof support units in a 90° turn, while making a breakthrough from a room 26 to another room **26*a* at right angles to it. Mobile roof support unit 22 is shown, just starting to make the turn, with the auxiliary frame 32 pivoted slightly to the left, by means of cylinder 58. The other unit 22*a* is farther advanced around the turn, providing roof support above the miner operator located at position 188 while two shuttle cars 190 and 190***a*, in two different entries, alternate in receiving the mined material from the continuous miner. By separately manipulating the individual roof support units 22 and 22*a*, the mining operation can be re-established in the new room 26*a* without exposing the mine operator or the roof bolting machine operators to unsupported roof.

Figure 15:
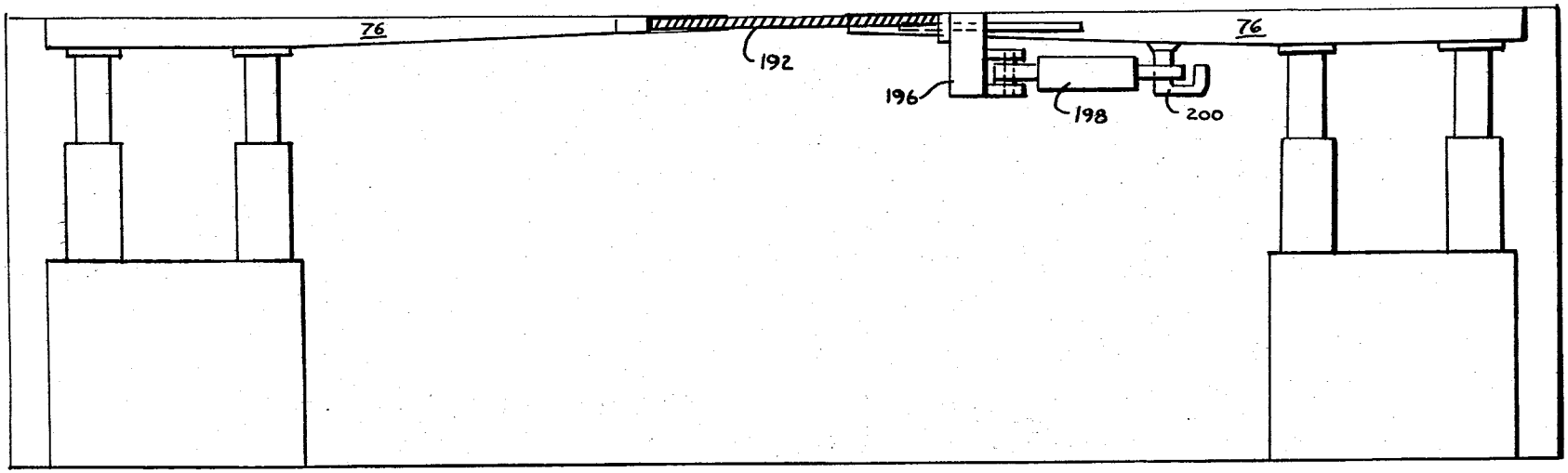
FIG. 15 is a side view of FIG. 14.
Figure 14:
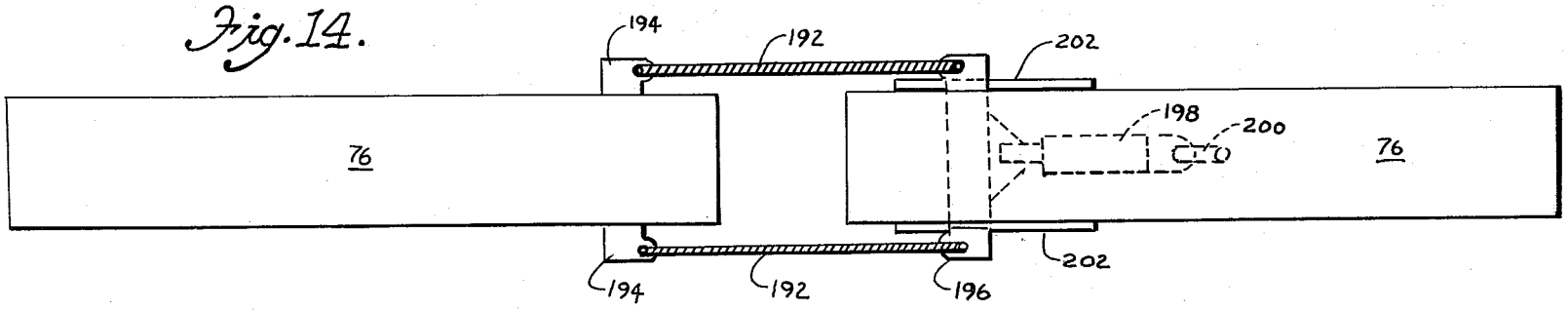
FIG. 14 is a fragmentary plan view showing canopies of a pair of mine roof support units interconnected to provide auxiliary support for the mine top at the center of the room.

FIGS. 14 and 15 illustrate an optional addition to the system where it is desirable to provide temporary support down the center of a room. This can occur where the top is in very bad condition and has to be supported continuously over the whole roof area. Here, wire ropes or chains 192 are fastened at one end to ears 194 on one of the canopies 76. The opposite ends of the wire ropes or chains are fastened to the ends of a cross bar 196 connected at its center to a hydraulic jack 198, attached to the opposite canopy 76 by bracket 200. The cross bar may be slidably mounted on a pair of guide bars 202, 202 is desired, although this will not be necessary in every case.

Alternatively, in very limited height conditions, the single cylinder jack 198 may be substituted by two separate cylinders (not shown) on opposite sides of the right hand canopy shown in FIGS. 14 and 15. Such two cylinders will preferably be located in substantially the same horizontal plane as the ropes or chains 192, to minimize their head room requirements.

The above described embodiments are illustrative of a number of many possible specific forms of the invention. Others can readily be devised in accordance with the principles disclosed by those skilled in the art, without departing from the spirit and scope of the invention.

The embodiments of the invention in which an exclusive property or privilege is claimed are defined as follows:

1. A mobile mine roof support unit comprising:

an elongated frame adapted to be positioned alongside a rib in a mine room or entry, said frame having a rib side adapted to be positioned ajacent a rib;

tramming means including ground-engaging elements on said frame and means for actuating said tramming means to move said frame in the room or entry;

pairs of vertical jacks connected to opposite sides of said frame, said pairs of jacks being spaced apart along the frame;

a foot plate extending transversely of the body and connected across the lower ends of each pair of jacks, each said pair of jacks being actuatable to move the respective foot plate vertically toward and away from a position engaging the mine bottom;

a canopy extending transversely of the body and connected across the upper ends of each pair of jacks and having an overhanging portion opposite the rib side of the frame adapted to extend cantileverly into the room or entry, each said pair of jacks being actuatable to move the respective canopy vertically toward and away from a position engaging the mine top; and universal pivotal connections between said jacks and the respective foot plate and canopy enabling said foot plate and canopy to tilt in any direction to accommodate deviation from the horizontal of the bottom and top surfaces of the room or entry.

2. A mobile mine roof support unit according to claim 1 in which said elongated frame includes an inbye section which is pivoted for horizontal swinging movement, power means for swinging said inbye section, and at least one of said pairs of jacks with their respective foot plate and canopy being mounted on said inbye section to support top when the unit advances to turn a breakthrough from one room or entry into another.

3. A mobile mine roof support system comprising two mine roof support units according to claim 1 in which said units are adapted to be disposed along opposite ribs of a room or entry to support the top while providing space beneath the canopies for movement and operation of mining equipment.

4. A mobile mine roof support unit according to claim 1 in which said jacks are loosely connected to said frame, means for locking to the frame each subassembly consisting of one of said pairs of jacks together with the respective foot plate and canopy to provide support for said subassembly during tramming, the locking means comprising means for actuating said jacks to press said foot plate against the underside of the frame, and means for releasing each said subassembly from the frame in response to actuating the jacks to move said foot plate downward against the mine bottom.

5. A mobile mine roof support unit, according to claim 4 in which each said foot plate and corresponding underside portion of the frame have vertically aligned interengageable V-wedge means for stabilizing the jacks in upright positions when the foot plate is pressed upwardly against the underside of the frame to engage said V-wedge means.

6. A mobile mine roof support unit according to claim 4 in which the jacks are loosely positioned and vertically movable within oversize openings in brackets attached to opposite sides of the frame, said jacks having external flanges intermediate their lengths engageable with the top surfaces of said brackets, said jacks being movable upwardly to disengage said flanges from the brackets in response to actuation of said jacks to move the respective foot plate downward against the bottom, said jacks being movable downwardly with the respective canopies supported thereby to bear said flanges against said brackets in response to actuation of said jacks to move the respective foot plate upward from the mine bottom, said jacks being effective, when the respective foot plate is fully retracted against the underside of the frame, to lock said subassembly rigidly between the corresponding brackets and the underside of the frame, thereby supporting said subassemblies rigidly relative to the frame with the canopies spaced downwardly from the mine top during tramming movement of the unit along a room or entry.

7. A mobile mine roof support unit according to claim 6 in which said jacks have conical surfaces beneath said flanges to center the jacks within said respective oversize openings in said brackets when the jacks are lowered to bear their said flanges against said brackets.

8. A mobile mine roof support unit according to claim 1 in which there are vertical guide surfaces on said rib side of the frame opposite the overhanging portions of the canopies, and the jack on the rib side is in vertically slidable relationship therewith to offset the weight of said overhanging portions.

9. A mobile mine roof support unit according to claim 1 in which each of said jacks has separately actuatable upper and lower portions connected to the respective canopy and foot plate.

10. A mobile mine roof support system according to claim 3 in which said two mine roof support units are adapted to be disposed along opposite ribs of a room or entry with canopies from the two units extending into the room in pairs toward one another in common vertical planes, and auxiliary top support means is connected between the adjacent ends of each opposed pair of canopies to support the mine top between the units in the center of the room or entry.

11. A mobile mine roof support system according to claim 10 in which said auxiliary top support means comprises elongated flexible elements tensioned between said adjacent ends of each opposed pair of canopies.

12. A mobile mine roof support system according to claim 11 in which tensioning means is provided for said flexible elements on one of said canopies to apply tension thereto for supporting the top between the adjacent ends of each opposed pair of canopies.

13. A mobile mine roof support system according to claim 12 in which said flexible elements are ropes or chains connected to one of each of said opposed pair of canopies and said tensioning means is an auxiliary jack connected to the other of each said opposed pair of canopies.

14. A mobile mine roof support system according to claim 12 in which said flexible elements comprise ropes or chains disposed in pairs along the sides of said canopies in position to support the room or entry top between the ends of each of said opposed pairs of canopies, said ropes or chains being connected at one end to one of said opposed pair of canopies, and connected at their opposite ends to a transverse yoke, and piston and cylinder means connecting said yoke to the other of said opposed pair of canopies.

15. A mobile mine roof support unit according to claim 1 in which a ventilation curtain is supported beneath the canopies parallel to the frame.

16. A mobile mine roof support unit according to claim 15 having extendible means supported by the inbye one of said canopies and connected to the inbye end of the ventilation curtain, said extendible means being actuatable to extend said ventilation curtain ahead of the unit toward a mine face.

17. A mobile mine roof support unit according to claim 15 in which said ventilation curtain is supported at the outbye end of a spool supported on said frame and is payed outwardly therefrom as needed.

* * * * *

UNITED STATES PATENT AND TRADEMARK OFFICE

CERTIFICATE OF CORRECTION

PATENT NO. : 4,307,982

DATED : December 29, 1981

INVENTOR(S) : Robert C. Nelson

It is certified that error appears in the above—identified patent and that said Letters Patent is hereby corrected as shown below:

In the Drawings

In the drawings, add thirty-six X's to each of Figures 8 through 12; add thirty-six heavy dots to Figure 12; and in Figure 13, apply an arrow head at the end of the lead line for the numeral 22, add numeral 58 with lead line, and add numeral 26a; all as follows:

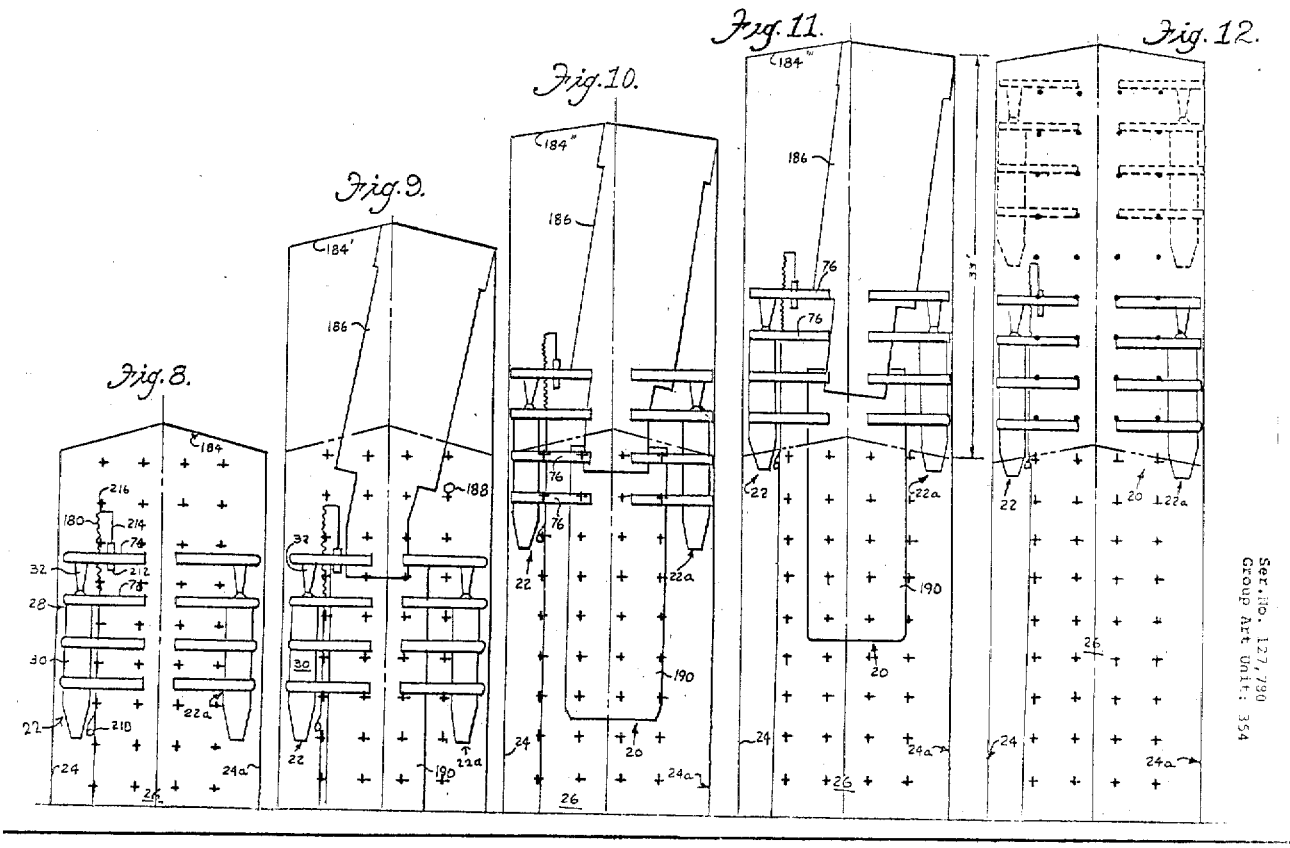

Ser. No. 127,790
Group Art Unit: 354

UNITED STATES PATENT AND TRADEMARK OFFICE

CERTIFICATE OF CORRECTION

PATENT NO. : 4,307,982

DATED : December 29, 1981

INVENTOR(S) : Robert C. Nelson

It is certified that error appears in the above—identified patent and that said Letters Patent is hereby corrected as shown below:

Fig. 13.

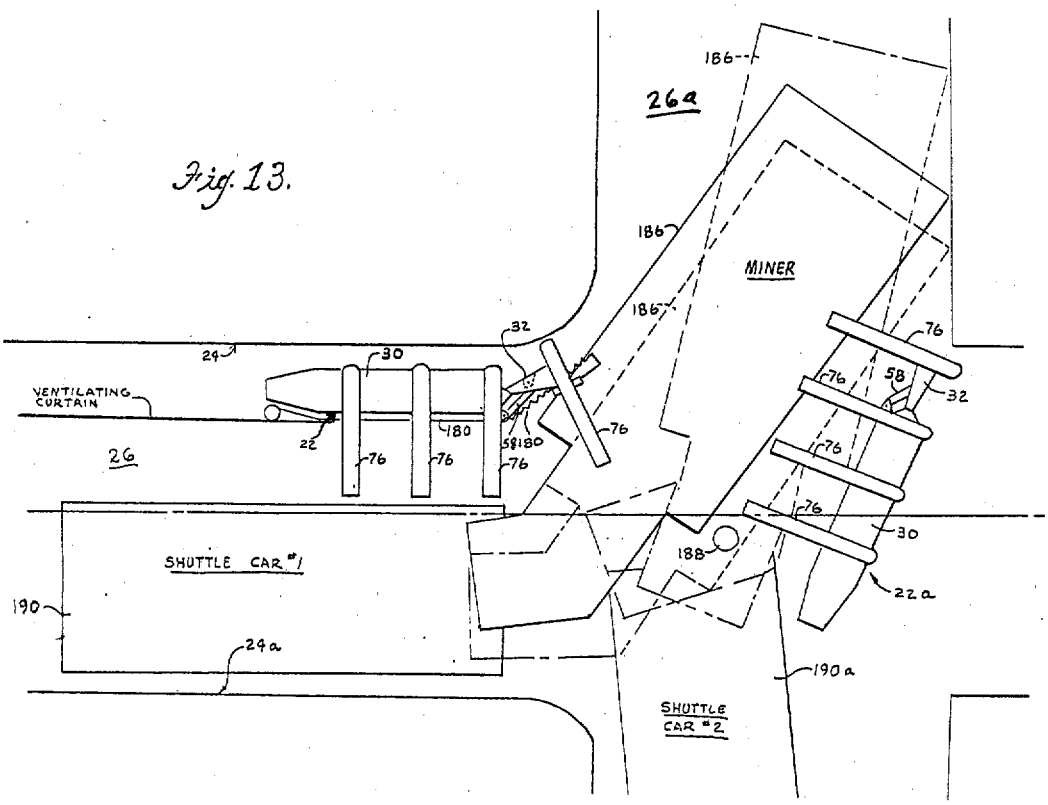

Ser. No. 127,780
Group Art Unit: 354

UNITED STATES PATENT AND TRADEMARK OFFICE

CERTIFICATE OF CORRECTION

PATENT NO. : 4,307,982

DATED : December 29, 1981

INVENTOR(S) : Robert C. Nelson

It is certified that error appears in the above—identified patent and that said Letters Patent is hereby corrected as shown below:

Column 2, line 54, "fragmview" should be -- fragmentary horizontal cross-sectional view --.

Column 5, line 9, "retract" should be -- retreat --.

Column 5, line 15, "motors" should be -- motor --.

Column 7, line 20, "is" should be -- if --.

In the Claims

Claim 1, line 4, change "ajacent" to -- adjacent --.

Signed and Sealed this

Thirtieth Day of March 1982

[SEAL]

Attest:

GERALD J. MOSSINGHOFF

Attesting Officer

Commissioner of Patents and Trademarks